United States Patent [19]

Oba

[11] Patent Number: 4,684,775

[45] Date of Patent: Aug. 4, 1987

[54] MINIATURE PUSH BUTTON SWITCH WITH COIL SPRING MOVABLE CONTACT

[75] Inventor: Hiroki Oba, Furukawa, Japan

[73] Assignee: Alps Electric Co., Japan

[21] Appl. No.: 813,580

[22] Filed: Dec. 26, 1985

[30] Foreign Application Priority Data

Dec. 25, 1984 [JP] Japan ..... 59-200036[U]

[51] Int. Cl.[4] ..... H01H 1/42

[52] U.S. Cl. ..... 200/276

[58] Field of Search ..... 200/276, 282

[56] References Cited

U.S. PATENT DOCUMENTS 4,488,018 12/1984 Hayashida ..... 200/276

FOREIGN PATENT DOCUMENTS 135864 12/1929 Switzerland ..... 200/276

OTHER PUBLICATIONS

Pickering, C. E., Electrical Switch in the *Research Disclosure* of Feb. 1979-p. 90.

*Primary Examiner*—Charles E. Phillips
*Assistant Examiner*—Renee S. Luebke
*Attorney, Agent, or Firm*—Guy W. Shoup

[57] ABSTRACT

A switch of the push-type is assembled using a housing provided with a clip formed integrally from a fixed lead terminal incorporated into the base of the housing. A torsion coil spring is fixed inside the housing with a free end available to be clamped by the clip. A slide for actuating the free end of the torsion coil spring is provided with a case cover to be coupled with the housing and the cover having a thru-hole through which one end of the slide projects outward.

The torsion coil spring serves as a movable contact means with respect to the clip and a returning means for the slide.

4 Claims, 5 Drawing Figures

MINIATURE PUSH BUTTON SWITCH WITH COIL SPRING MOVABLE CONTACT

BACKGROUND OF THE INVENTION

1. Field of the Invention

This invention relates to a switch and, more particularly, to a push switch of small dimension requiring only a small torque.

2. Description of the Prior Art

The push switch of the prior art was generally composed of a number of components such as a housing provided with a fixed terminal, a movable contact engageable with the fixed terminal of the housing, a slide for actuating the movable contact, a lever for actuating the slide, a spring for returning the lever and the slide to their initial positions, and a case coupled to the housing to form a switch casing.

Apparently the conventional switch needed a number of structural parts, was difficult to miniaturize, and required complicated assembling work, which resulted in an increase in manufacturing cost.

SUMMARY OF THE INVENTION

It is the object of the present invention to solve the foregoing problems of the prior art and to provide a switch which is reduced in number of parts, easily miniaturizable, adapted to an assembling process using an automated assembling machine, and lowered in manufacturing cost.

In order to achieve the foregoing object, the present invention provides a switch which comprises a housing provided with a clip formed integrally with a fixed lead terminal, a torsion coil spring held inside the housing and having a free end clampingly engageable with the clip, a slide for actuating the free end of the torsion coil spring to engage with the clip, and a case coupled to the housing and having a thru-hole through which one end of the slide projects outward.

DETAILED DESCRIPTION OF THE PREFERRED EMBODIMENT

An embodiment of the present invention will now be described with reference to the drawings.

Figure 1:
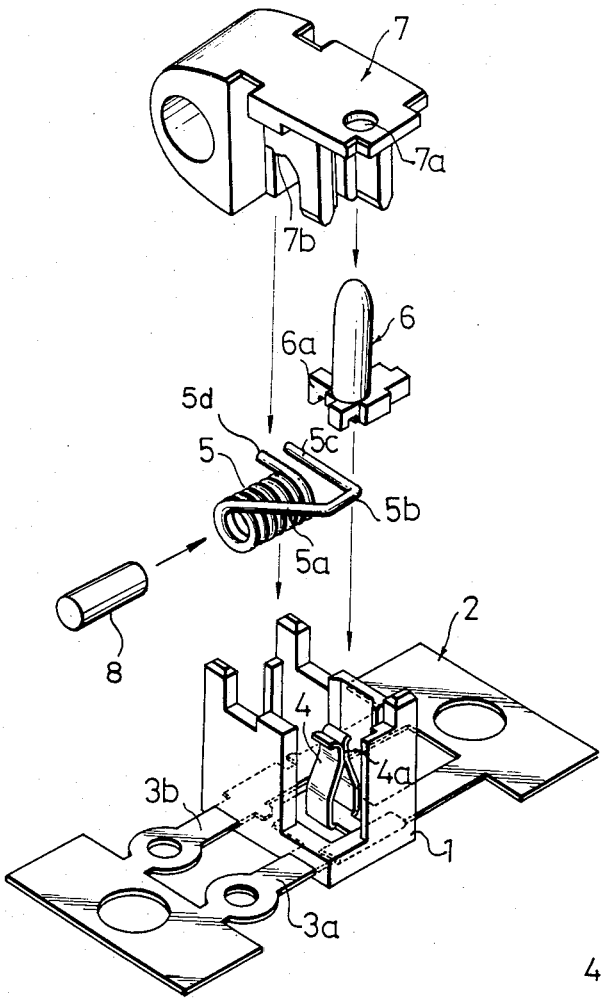
FIG. 1 is an exploded perspective view of a switch according to the present invention.
Figure 2:
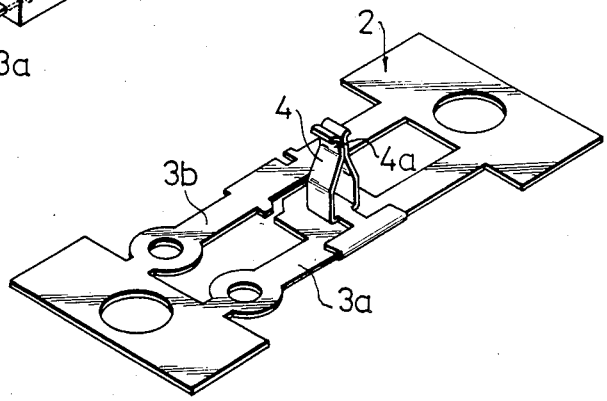
FIG. 2 is a perspective view of a segment of a contact member which is incorporated into a housing by insert molding.

In the drawings, reference numeral 1 indicates a housing which is made from insulating material in the form of an open box having a segment of a contact member 2 such as shown in FIG. 2 insert molded into its bottom as shown in in FIG. 1. The member 2 includes fixed lead terminals 3*a*, 3*b*, a T-shaped portion of one fixed lead terminal 3*a* being folded 180 degrees and then bent 90 degrees uprightly at its ends thereby forming an erecting clip 4 which is integral with the terminal. Accordingly, the housing 1 has the fixed lead terminals 3*a*, 3*b* and the clip 4 already incorporated at the earliest stage of manufacture.

Reference numeral 5 indicates a torsion coil spring which is preferably silver-plated. One end of a coil section of the spring has a straight elongation 5*a* (extension arm), from this elongation 5*a* there is a bend in the axial direction of the coil section thereby forming a receiving portion 5*b* for receiving a pushing force of a slide described hereinafter, and the further end of the receiving portion 5*b* is bent toward the coil section with an angle of $\alpha$ left between it and the elogation 5*a* thereby forming a movable contact portion 5*c* (contact arm).

Reference numeral 6 indicates a slide having an engaging portion 6*a* engagable with the receiving portion 5*b* of the torsion coil spring 5, the end of this slide 6 projecting upward and outside a case described hereinafter and serving as a push lever of the conventional structure. The movable contact portion 5*c* of the coil spring 5 by the slide 6 via the receiving portion 5*b*, and the torsion of the coil spring serves as a returning means for urging the slide 6 upward to return it to the initial position.

Reference numeral 7 indicates a case portion which forms a switch casing when coupled to the housing 1. This case portion 7 has a thru-hole 7*a* through which one end of the slide 6 passes, on the back side it has an expanded portion 7*b* for holding down the torsion coil spring 5 to contact the terminal 3*b*, and a guide groove for receiving the second end 5*d* of the torsion coil spring 5.

Figure 3A:
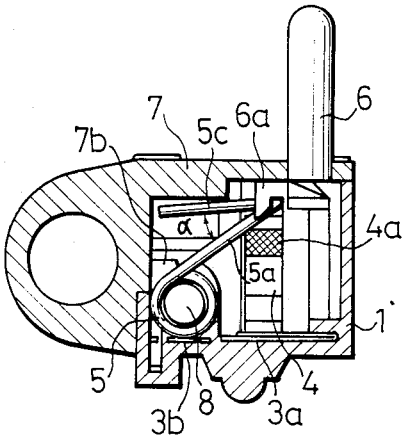
FIGS. 3A through 3C are cross sectional views showing the operation positions of the switch.
Figure 3B:
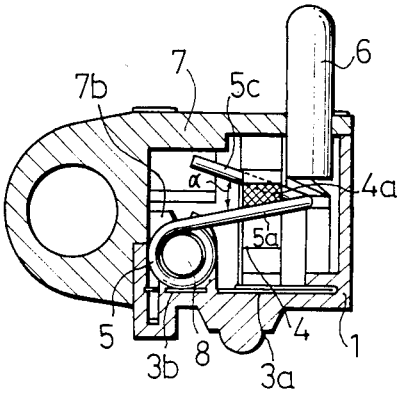
Figure 3C:
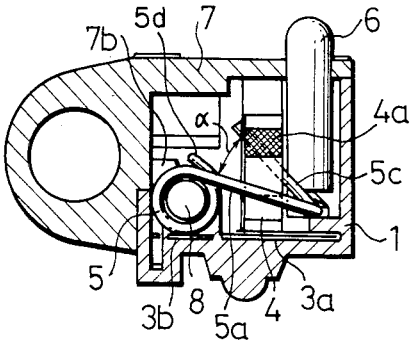

In the foregoing structure, when the slide 6 is pushed down from the above, as shown in FIGS. 3A through 3C, the engaging portion 6*a* of the slide 6 comes into engagement with the receiving portion 5*b* of the torsion coil spring 5 held by a shaft 8 and pushes down the same. In response to this pushing-down the movable contact portion 5*c* engages and is clamped by clamp contact portions 4*a* of the clip 4. At this position, because the movable contact portion 5*c* of the torsion coil spring 5 was bent to have an angle of $\alpha$ with respect to the elongation 5*a*, even when the slide 6 is pushed down through the full stroke thereof, the extent of relative shift of the contacting point between the movable contact portion 5*c* and the clamp contact portion 4*a* of the clip 4 is small in comparison with the moved distance of the slide; thus, the clamp contact portion 4*a* of the clip 4 can be designed with a small area so that cost is reduced when the contact portion 4*a* is to be plated with silver.

As is apparent from the foregoing description, according to the present invention, the housing is provided from the first stage of manufacture with the clip 4 integral with the fixed lead terminal 3*a*, the torsion coil spring 5 functions as both the movable contact and the returning means, and the slide 6 serves as the lever also. Only a small torque is required to slip the contact portion 5C between the clamping fingers of the clip 4. And the contact area 4*a* of the clip 4 can be made small when the angle is appropriately chosen. Accordingly, the present switch is remarkably reduced in number of structural parts, can be manufactured by the use of an automated assembling machine, is simplified in assembling work, and can be produced at low manufacturing costs.

While the preferred embodiment has been described, variations thereto will occur to those skilled in the art within the scope of the present invention concepts which are delineated by the following claims.

What is claimed is:

1. A pushbutton switch comprising:

a housing;

a first contact member mounted on a bottom portion of the housing, said contact member having a clip integrally formed therewith extending upright from the bottom portion of the housing at an intermediate position between two sides of the housing, wherein said contact member is formed from a flat conductive terminal having one coplanar projected portion thereof folded back 180 degrees and opposite end portions of said folded projected portion bent substantially 90 degrees upright to form said clip;

a torsion coil spring mounted to one side of the housing and having one end thereof formed with a straight elongation portion extending from a wound portion of said coil spring toward an opposite side of the housing, a receiving portion bent 90 degrees to said straight elongation portion and extending in an axial direction of the wound part of said coil spring, and a movable contact portion bent 90 degrees to said receiving portion and at an upright angle to said straight elongation portion and extending back toward said one side of the housing above said clip; and a pushbutton movably mounted so as to project upright from an upper portion of the housing and having an engaging portion at a lower end thereof which is engaged with said receiving portion of said coil spring for pushing said movable contact portion into electrical contact with said clip when said pushbutton is depressed.

2. A pushbutton switch according to claim 1, wherein said angle of said movable contact portion to said straight elongation portion of said coil spring is selected so as to allow said movable contact portion to be engaged with a relatively small contact length of said clip even if said pushbutton is depressed full-stroke so as to push said receiving portion down a length much longer than said contact length.

3. A pushbutton switch according to claim 1, wherein a second contact member is mounted on the bottom portion of the housing in electrical contact with said wound portion of said coil spring.

4. A pushbutton switch according to claim 3, wherein said first and second contact members are insert-molded in the bottom portion of the housing.

* * * * *